United States Patent [19]

Höffgen

[11] Patent Number: 4,616,809

[45] Date of Patent: Oct. 14, 1986

[54] GAS BUBBLE BRICK FOR METALLURGICAL VESSELS

[76] Inventor: Hans Höffgen, IM Silbertal 13, 5410 Höhr-Grenzhausen, Fed. Rep. of Germany

[21] Appl. No.: 664,437

[22] Filed: Oct. 24, 1984

[30] Foreign Application Priority Data

Nov. 17, 1983 [DE] Fed. Rep. of Germany ..... 3341446

[51] Int. Cl.[4] ..... C21B 7/16

[52] U.S. Cl. ..... 266/220; 222/603

[58] Field of Search ..... 266/220, 217, 270, 224, 266/223, 218, 265; 222/591, 603, 597

[56] References Cited

U.S. PATENT DOCUMENTS

| | | | |
|---|---|---|---|
| 2,956,794 | 10/1960 | Allard | 266/223 |
| 3,615,086 | 10/1971 | Jepson, III et al. | 266/220 |
| 3,834,685 | 9/1974 | Ziemkiewicz et al. | 266/220 |
| 4,019,725 | 4/1977 | Cote | 266/218 |
| 4,423,858 | 1/1984 | Östlund | 266/270 |
| 4,470,582 | 9/1984 | Shaw et al. | 266/266 |

FOREIGN PATENT DOCUMENTS

| | | | |
|---|---|---|---|
| 0337397 | 1/1972 | U.S.S.R. | 266/220 |

*Primary Examiner*—L. Dewayne Rutledge
*Assistant Examiner*—S. Kastler
*Attorney, Agent, or Firm*—Browdy and Neimark

[57] ABSTRACT

A gas bubble brick for metallurgical vessels consists of a porous, gas-permeable shaped brick (2) made of refractory material, a gas-tight partial encasing surrounding the latter, which encasing is welded together from a metal jacket (4) extending around the lateral circumferential area of the shaped brick and a metal cover (6) covering the outer face of the shaped brick, a gas supply pipe (10) which is welded to the rim of a central gas inlet orifice (8) of the metal cover (6), as well as a breakthrough safeguard in the area of the gas supply pipe. In order to prevent closure of the gas bubble brick in the gas outlet area and in order thereby to ensure purge readiness, a constricted cross-section (12) is provided inside the gas supply pipe (10) at a distance from the gas inlet orifice (8) of the metal cover (6), there being provided in the pipe section between the metal cover and the constricted cross-section a closure body (17), which is movable at least in the axial direction of the gas supply pipe and is, for example, a copper ball or the like, the cross-section of which is smaller than the inside diameter of the gas supply pipe (10) and greater than the constricted cross-section (12). The closure body (17), together with the constricted cross-section (12), thereby forms a non-return valve, which prevents a pressure drop occurring in the gas bubble brick after switching off the gas supply.

3 Claims, 2 Drawing Figures

GAS BUBBLE BRICK FOR METALLURGICAL VESSELS

Figure 1:
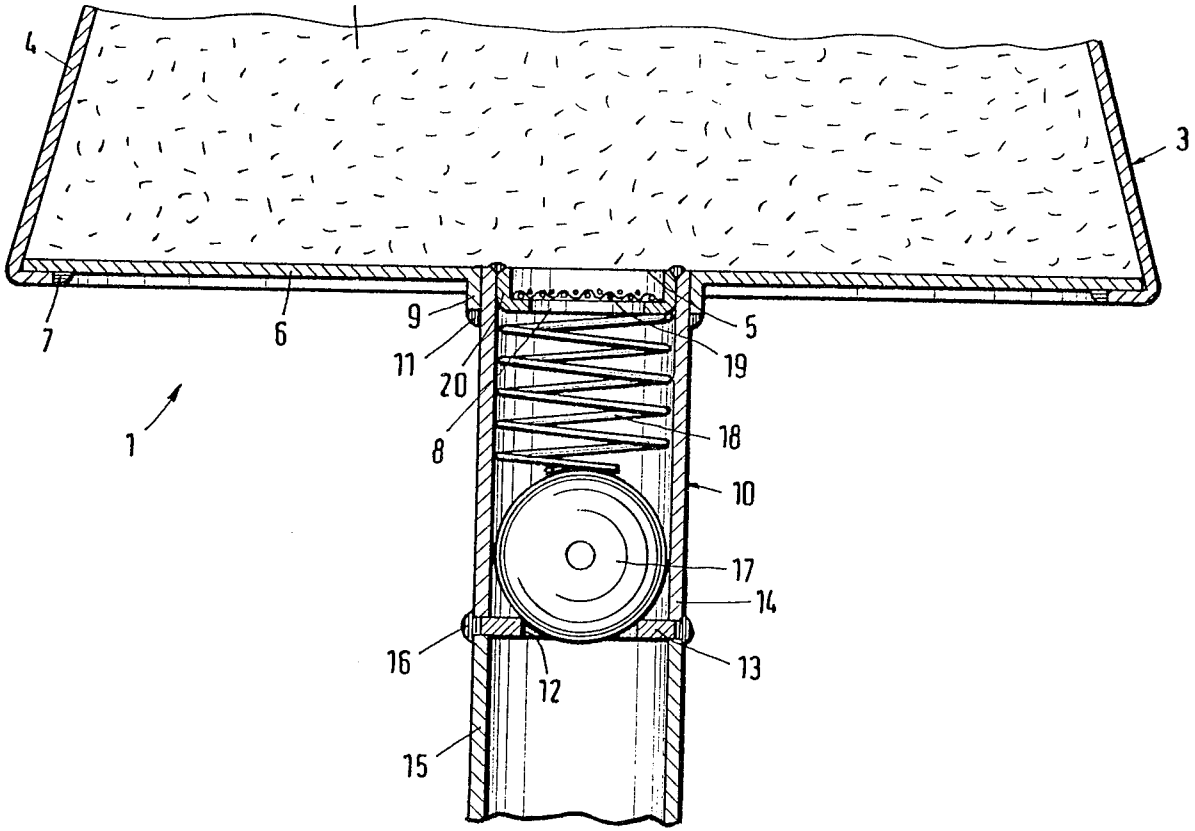

The invention relates to a gas bubble brick for metallurgical vessels consisting of a porous, gaspermeable shaped brick made of refractory material, a gas-tight partial encasing surrounding the latter, which encasing is welded together from a metal jacket extending around the lateral circumferential area of the shaped brick and a metal cover covering the outer face of the shaped brick, a gas supply pipe which is welded to the rim of a central gas inlet orifice of the metal cover, as well as a break-through safeguard in the area of the gas supply pipe.

Gas bubble bricks of the type stated, which can be installed in the bottom or in the side walls of the vessels, are used for blowing inert gases into the melt to be treated. The inert gas treatment offers various metallurgical advantages, for example bringing down the temperature profile in the ladle and thus fast adjustment of the optimum pouring temperature, homogeneous distribution of the alloying agents or of the deoxidising agents in the vessel, improvement of the degree of purity of the steel by transporting the non-metallic contaminants into the slag, as well as partial removal of gases, facilitating agitation in metallurgical reactions to achieve concentration equalisation of the melt and so forth.

Gas bubble bricks are admittedly pre-programmed wear parts, but gas bubble brick technology is already so far advanced that a single brick withstands a relatively high number of batches. Wear of the bricks occurs primarily on the gas outlet side which is in contact with the melt. A frequent occurrence is that the melt enters the pores and clogs them to such an extent that the outlet area of the bubble brick becomes closed and hence so-called purge interrupts can occur.

The invention is based on the object of preventing closure of the gas bubble bricks in the gas outlet area and thereby ensuring purge readiness.

This object is achieved according to the invention in that a constricted cross-section is provided in the gas supply pipe at a distance from the gas inlet orifice of the metal cover and in that there is provided in the pipe section between the metal cover and the constricted cross-section a closure body, which is movable at least in the axial direction of the gas supply pipe and the cross-section of which is smaller than the inside diameter of the gas supply pipe and greater than the constricted cross-section, the closure body, together with the constricted cross-section, forming a non-return valve.

By means of the construction according to the invention, the non-return valve closes directly after completion of the purge operation, so that no pressure drop occurs in the bubble brick and thus the melt does not penetrate into the pores of the bubble brick after completion of the purge operation.

After the inert gas supply to the bubble brick has been cut, a pressure increase can even occur in the gas bubble brick due to the heating and associated expansion of the residual gas, so that not only is the closure body pushed into its closed position, but a secure protection against penetrating melt entering the pores of the bubble brick is also created.

In addition, the non-return valve also acts as a break-through safeguard. Due to the prevention of pressure drop in the gas passages in the bubble brick after switching off the gas supply, the resistance of the bubble brick material is increased, the compressed gas cushion arising in the gas bubble brick contributing in particular to this effect. Thus, by means of the construction according to the invention, it is possible to dispense with elaborate break-through safeguards.

The valve body, which is of relatively large design and can almost fill the entire free cross-section of the gas supply pipe, is preferably made of copper. Copper is a material which can absorb large quantities of heat in a short time. Should a melt break-through occur in spite of the construction according to the invention, the melt penetrating the gas supply pipe solidifies immediately upon contact with the closure body made of copper, meaning that this creates an additional break-through safeguard.

The constricted cross-section provided in the gas supply pipe can be formed by a perforated disc, the central aperture of which forms the valve seat. Such a valve seat is easy to produce with little expenditure.

In order to ensure that the section of the gas supply pipe acting as valve element remains operative even over prolonged periods, the pipe section between the metal cover and the perforated disc and also the perforated disc can be made of stainless steel.

Furthermore, a compression spring can be provided between the closure body and the metal cover, which spring presses the closure body against the valve seat. This measure ensures that the bubble brick can be used in any desired position.

A screen can be arranged in the area of the gas inlet orifice of the metal cover or somewhat underneath it, so that no refractory substance which may crumble from the bubble brick material can reach the area of the valve seat.

The screen can be fixed in an annular perforated cap welded into the inside cross-section of the gas supply pipe, which cap can be used simultaneously as a counter-bearing for the compression spring.

The valve body can be designed as a ball which can optimally close the passage through the constricted cross-section.

Alternatively, it is also possible to design the closure body as a solid, cylindrical part, the diameter of which is only a little smaller than the inside diameter of the gas supply pipe and which has on its side interacting with the constricted cross-section of the gas supply pipe a tapering end piece engaging in the constricted cross-section. The end piece is appropriately designed as a truncated cone. The cylindrical closure body can be equipped with a large mass of good thermal conductivity, so that in the event of melt break-through a spontaneous chill effect of the penetrating melt is achieved, an additional seal being produced by the melt solidified in the area of the closure body.

It is appropriate to provide a central recess in the face of the end of the cylindrical closure part remote from the constricted cross-section, by means of which the heat-conducting contact area presented to any penetrating melt is increased, thereby improving the chill effect still further.

As an additional break-through safeguard, a ring made of refractory material can be arranged around the gas supply pipe, the outside diameter of which ring appropriately being larger than the largest diameter of the shaped brick and the ring being attachable to a perforated brick or the vessel masonry by means of a rim protruding in the axial direction and engaging over the broader end of the shaped brick.

Figure 2:
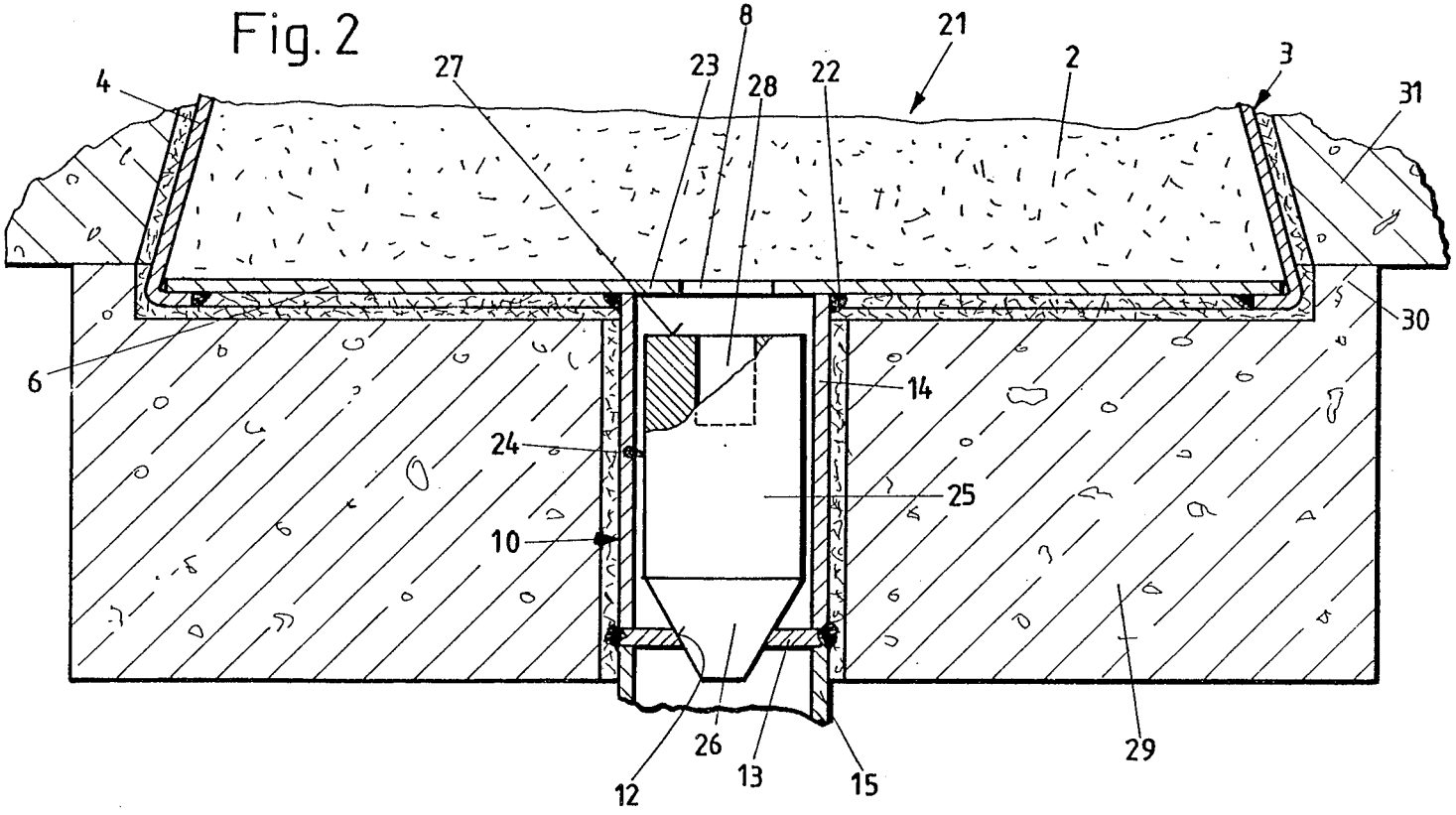

An example of the invention is illustrated in the drawing and described in detail below with reference to the drawing, in which FIG. 1 shows a section through an exemplary embodiment of a gas bubble brick and FIG. 2 shows a section through another exemplary embodiment of a gas bubble brick.

According to FIG. 1 of the drawing, the gas bubble brick 1 consists of a gas-permeable shaped brick 2 in the shape of a truncated cone, which can be installed in the bottom or in the wall of a metallurgical vessel not shown in the drawing. A purge gas, for example argon, is passed through the gas bubble brick into the metal melt present in the metallurgical vessel. The gas bubble brick is a wear part, which is replaced by a new gas bubble brick after a certain number of batches.

The gas bubble brick 1 is partially provided with a gas-tight metal encasing 3. This consists of a closely fitting metal jacket 4 and a round metal cover 6 which contacts the outer face 5 of the shaped brick and extends up to the outer edge of the face 5 of the shaped brick. The outer edge of the metal jacket 4 is flanged around the metal cover 6 and joined gas-tight to the metal cover by means of a welding seam 7 which runs at a distance from the edge of the metal cover 6.

In its centre, the metal cover 6 has a round gas inlet orifice 8, which is provided with an axially protruding cylindrical rim 9. A gas supply pipe 10 is fitted into the gas inlet orifice 8 provided with the cylindrical rim 9 and the rim 9 of the gas inlet orifice 8 is welded to the external circumference of the pipe by a seam 11 running around.

Inside the gas inlet pipe 10, a constricted cross-section 12 formed by a perforated disc 13 is provided at a distance from the gas inlet orifice 8 of the metal cover 6. For fitting the perforated disc 13, the gas supply pipe 10 is of split design and consists of a first section 14 which is welded to the metal cover 6, and a second adjoining section 15, to which the gas supply is connected. The perforated disc 13 is inserted between the two pipe sections 14 and 15 and all three parts are joined together by means of a common welding seam 16 running round.

The pipe section 14 adjoining the metal cover 6, and the perforated disc 13 are made of high-grade stainless steel so that no disturbing corrosion can occur in the interior of the pipe section 14 which is to act as valve-receiving housing and valve seat.

The valve body is in the form of a relatively large copper ball 17, which is only slightly smaller than the inside cross-section of the pipe section 14. Together with the perforated disc 13, the ball 17 forms a non-return valve.

The ball 17 is raised from the valve seat by the purge gas flowing up via the second pipe section 15, so that the valve does not present any, or only slight, resistance in the flow direction of the purge gas. If, on the other hand, the purge gas inflow is interrupted, the valve is closed so that no pressure drop can be produced inside the bubble brick.

In order to improve the closing effect, the copper ball 17 is subjected to the action of a helical compression spring 18, so that the ball 17 can be deliberately pushed into its closed position. The windings of the spring 18 reach almost up to the interior wall of the pipe section 14, so that the spring 18 is guided by the pipe. This bubble brick construction with compression spring is also suitable for use of the bubble brick in oblique or even vertical vessel walls.

At a slight distance from the face 5 of the shaped brick 2, a screen 19 is arranged in the pipe section 14 and is intended to prevent disturbing particles from entering the valve chamber so that the valve seat always remains clean and thus ready for operation. The screen 19 rests in a perforated cap 20 which is welded into the inside cross-section of the pipe section 14. The perforated cap 20 serves at the same time, on the side remote from the valve seat, as a counter-bearing for the compression spring 18.

The gas bubble brick 21 shown in FIG. 2 corresponds to the greatest extent to the embodiment shown in FIG. 1, so that the same reference symbols have been used for the same parts.

In this second exemplary embodiment too, the gas bubble brick 21 consists of a gas-permeable shaped brick 2 in the shape of a truncated cone, having a metal encasing 3 which is welded together from a closely fitting metal jacket 4 and a round metal cover 6. The central gas inlet orifice 8 provided in the metal cover 6 is formed by a round punch-put, the diameter of which is smaller than the inside diameter of the gas supply pipe 10. The upper section 14 of the gas supply pipe 10 is welded directly to the underside of the metal cover 6 via a welding seam 22, so that the rim of the metal cover 6 surrounding the gas inlet orifice 8 projects into the cross-section of the gas supply pipe 10.

In this exemplary embodiment too, a constricted cross-section 12 formed by a perforated disc 13 is provided inside the gas supply pipe 10 at a distance from the gas inlet orifice 8 of the metal cover 6. The perforated disc is welded in between the two pipe sections 14 and 15, which form the gas supply pipe 10.

Unlike the first exemplary embodiment, the closure body 24 which is arranged inside the upper pipe section 14, is designed as a solid, cylindrical part 25, the diameter of which is only a little smaller than the inside diameter of the gas supply pipe 10. On its side facing the constricted cross-section 12, the cylindrical part 25 is provided with an end piece 26 in the shape of a truncated cone, which engages in the perforated disc 13 and forms a tight closure when the two are in contact. This closure body 24, which acts predominantly under its own weight, can only be used with gas bubble bricks 21 installed in the bottom of a metallurgical vessel, the gas supply pipe 10 adopting a vertical position.

The upper face 27 of the closure body 24 is provided with a central recess 28, which is designed as a cylindrical sunken cavity. The recess 28 has the object of increasing the surface area in the case of the cylindrical part 25, preferably made of copper, so that in the event of a melt break-through there can be an immediate solidification of the melt.

As an additional break-through safeguard, a ring 29 made of refractory material is arranged around the gas supply pipe 10. The outside diameter of the ring 29 involved is larger than the largest diameter of the shaped brick 2 so that the ring protrudes laterally over the shaped brick. In this projecting area, the ring 29 is provided with a rim 30 extending in the axial direction, which engages over the broader end of the shaped brick 2 and is in contact with the underside of a perforated brick 31.

I claim:

1. Gas bubble brick for metallurgical vessels consisting of a porous, gas-permeable shaped brick made of refractory material, a gas-tight partial encasing surrounding the latter, which encasing is welded together from a metal jacket extending around the lateral curcumferential area of the shaped brick and a metal cover covering the outer face of the shaped brick, a gas supply pipe which is welded to the rim of a central gas inlet orifice of the metal cover, as well as a break-through safeguard in the area of the gas supply pipe, wherein a constricted cross-section, defining a valve seat, is provided in the gas supply pipe at a distance from the gas inlet orifice of the metal cover, a closure body is provided in the pipe section between the metal cover and the constricted cross-section, said body being movable at least in the axial direction of the gas supply pipe, and a compression spring is provided between the closure body and the metal cover which presses the closure body against the valve seat, the cross-section of said closure body being smaller than the inside diameter of the gas supply pipe and greater than the constricted cross-section, the closure body, together with the constricted cross-section, forming a non-return valve.

2. Gas bubble brick for metallurgical vessels consisting of a porous, gas-permeable shaped brick made of refractory material, a gas-tight partial encasing surrounding the latter, which encasing is welded together from a metal jacket extending around the lateral curcumferential area of the shaped brick and a metal cover covering the outer face of the shaped brick, a gas supply pipe which is welded to the rim of a central gas inlet orifice of the metal cover, as well as a break-through safeguard in the area of the gas supply pipe, wherein a constricted cross-section, defining a valve seat, is provided in the gas supply pipe at a distance from the gas inlet orifice of the metal cover, a closure body is provided in the pipe section between the metal cover and the constricted cross-section, said body being movable at least in the axial direction of the gas supply pipe, and a screen is arranged in the gas inlet orifice of the metal cover underneath the cover and above the closure body, the screen being fixed in an annular perforated cap welded into the inside cross-section of the gas supply pipe, the cross-section of said closure body being smaller than the inside diameter of the gas supply pipe and greater than the constricted cross-section, the closure body, together with the constricted cross-section, forming a non-return valve.

3. Gas bubble brick according to claim 2, wherein a compression spring, which presses the closure body against the valve seat, is provided between the closure body and the metal cover, and said perforated cap acts as a counterbearing for said compression spring.

* * * * *